US009775781B2

(12) United States Patent
Wheeler et al.

(10) Patent No.: US 9,775,781 B2
(45) Date of Patent: Oct. 3, 2017

(54) PATIENT ENTERAL HYDRATION WITH COOLED FLUIDS

(71) Applicant: Webster Rock, LLC, Webster Groves, MO (US)

(72) Inventors: Jeffrey Lee Wheeler, Castle Rock, CO (US); Kari Nicole Whitaker Wheeler, Castle Rock, CO (US); Brian Michael Chier, Webster Groves, MO (US)

(73) Assignee: Webster Rock, LLC, Webster Groves, MO (US)

( * ) Notice: Subject to any disclaimer, the term of this patent is extended or adjusted under 35 U.S.C. 154(b) by 0 days.

(21) Appl. No.: 15/087,170

(22) Filed: Mar. 31, 2016

(65) Prior Publication Data

US 2016/0213574 A1 Jul. 28, 2016

Related U.S. Application Data

(60) Division of application No. 14/067,027, filed on Oct. 30, 2013, which is a continuation-in-part of (Continued)

(51) Int. Cl.
*A61J 9/00* (2006.01)
*A47G 21/18* (2006.01)
(Continued)

(52) U.S. Cl.
CPC ..... *A61J 9/006* (2013.01); *A47G 21/187* (2013.01); *A61J 1/10* (2013.01); *A61J 1/1425* (2015.05);
(Continued)

(58) Field of Classification Search
CPC ... A47G 21/187; A61J 15/0011; A61J 1/1425; A61J 1/1462; A61J 7/00; A61J 9/006;
(Continued)

(56) References Cited

U.S. PATENT DOCUMENTS 2,756,740 A 7/1956 Deane
2,969,064 A 1/1961 Metz
(Continued)

OTHER PUBLICATIONS

O'Keefe, SJ, A guide to enteral access procedures and enteral nutrition. Nat. Rev. Gastroenterol Hepatol., 2009, vol. 6, No. 4, pp. 207-215.

*Primary Examiner* — Nathan R Price
*Assistant Examiner* — Melissa A Snyder
(74) *Attorney, Agent, or Firm* — Stinson Leonard Street LLP

(57) ABSTRACT

A device and method for enterally hydrating a patient with cooled fluids. The patient may be a paralyzed or limited upper body mobility patient with a functional gastrointestinal system who is nonetheless incapable or not fully capable of drinking unassisted. Here fluids are provided by a suspended container which also has a pouch to admit cooling material such as ice, but to keep the cooling material separate from the fluid. The container may also have optional graduation markings to allow for convenient estimation of fluid use, and an upper open and closeable cap to allow the container to be refilled. The container has a lower fluid conducting tube that terminates in a mouthpiece. The mouthpiece contains a fluid valve formed from at least one slit in an elastic material. Patient mouth force on the valve causes the slit to enlarge, thus enabling cooled fluid to flow into the patient.

9 Claims, 11 Drawing Sheets

Related U.S. Application Data application No. 13/347,274, filed on Jan. 10, 2012, now abandoned.

(60) Provisional application No. 61/431,309, filed on Jan. 10, 2011.

(51) Int. Cl.

| | |
|---|---|
| ***A61J 15/00*** | (2006.01) |
| ***A61J 1/10*** | (2006.01) |
| ***A61J 9/06*** | (2006.01) |
| *A61J 1/14* | (2006.01) |

(52) U.S. Cl.

CPC ..... *A61J 9/0661* (2015.05); *A61J 15/0011* (2013.01); *A61J 1/1462* (2013.01); *A61J 15/0092* (2013.01); *A61J 2200/44* (2013.01); *A61J 2200/76* (2013.01)

(58) Field of Classification Search

CPC .... A61J 1/10; A61J 1/14; B65B 55/02; B61D 1/28; A61L 2/00; A61M 5/1418

See application file for complete search history.

(56) References Cited

U.S. PATENT DOCUMENTS

| | | | | |
|---|---|---|---|---|
| 4,529,102 | A | 7/1985 | Quinn et al. | |
| 4,966,580 | A | 10/1990 | Turner | |
| 4,998,400 | A * | 3/1991 | Suzuki ..... | A61J 1/16 426/124 |
| 5,085,349 | A | 2/1992 | Fawcett | |
| 5,484,405 | A | 1/1996 | Edstrom, Sr. | |
| 5,730,336 | A | 3/1998 | Lerner | |
| 6,587,934 | B2 | 7/2003 | Miura et al. | |
| 7,007,502 | B2 * | 3/2006 | Kreutzmann ..... | A42B 3/048 62/457.2 |
| 8,157,764 | B2 | 4/2012 | Makowski et al. | |
| 8,328,049 | B1 | 12/2012 | Murrieta | |
| 2002/0011583 | A1 | 1/2002 | Getzewich et al. | |
| 2002/0113101 | A1 | 8/2002 | Skillern | |
| 2010/0318024 | A1 * | 12/2010 | Makowski ..... | A61J 1/1475 604/77 |

* cited by examiner

PATIENT ENTERAL HYDRATION WITH COOLED FLUIDS

CROSS-REFERENCE TO RELATED APPLICATIONS

This nonprovisional application is a divisional application which claims priority to U.S. patent application Ser. No. 14/067,027, filed on Oct. 30, 2013 titled PATIENT ENTERAL HYDRATION WITH COOLED FLUIDS which is a continuation-in-part of U.S. patent application Ser. No. 13/347,274, filed on Jan. 10, 2012, which claims priority to U.S. Provisional Patent Application Ser. No. 61/431,309, titled PATIENT ENTERAL HYDRATION WITH COOLED FLUIDS, filed on Jan. 10, 2011, each of which is hereby incorporated by reference in its entirety.

BACKGROUND OF THE INVENTION

1. Field of the Invention

This invention is in the field of therapeutic devices for enterally (e.g. by mouth) hydrating patients with cooled fluids.

2. Description of the Related Art

Ensuring that a patient is adequately hydrated is one of the most fundamental levels of medical care. Absent adequate hydration, blood pressure can fall dangerously low, blood may fail to adequately circulate, and organs may begin shutting down.

As a result, there has been a substantial amount of prior art interest in ensuring that patients are adequately hydrated. At present, the first line of hydration often begins with placing an IV line for direct parenteral administration of fluid directly into the patient's veins, it is often not ideal to keep this up for long. IV administration requires sterile fluids and IV lines, can expose the patient to some risk of infection, and other complications. If the patient is subsequently able to drink fluids without assistance, IV fluid administration will often be stopped and the patient directly "stepped down" to self enteral administration (e.g. by mouth). This self enteral administration can be as simple as providing the patient with a cup often a pitcher of fluid, along with instructions as to how much to drink.

Some patients, however, remain unable to drink fluids without assistance, often for some period of time. These "unable to drink" patients generally fall into two categories. One category may suffer from severe sickness that hampers the enteral fluid administration route, and/or be so incapacitated as to be unable to swallow (i.e. many intensive care patients). A second category may have an adequately functioning enteral system (i.e. able to swallow, stomach can handle fluids, intestine can absorb fluids and so on), yet be unable to use a cup without assistant. This can range from individuals with both upper arms in a cast, to other upper extremity injuries, arm amputations, partial or total paralysis, and the like.

At present patients who are at least able to sip and swallow and otherwise adequately handle fluids by mouth are often stepped down from IV administration, and their fluid needs are instead handled by assisted enteral administration. This assistance is often done by having a nurse or family member hold the cup up to the patient's lips, and allow them to sip and swallow. However this assisted enteral fluid administration route is quite time consuming, and whenever possible, the preferred option is to step the assisted enteral administration patient down to self enteral administration as soon as feasible.

Because of the high amounts of labor required for assisted enteral administration, other workers have suggested methods to automate or semi-automate the process.

For example, Deane in U.S. Pat. No. 2,756,740 proposed a drinking device for hospital patients that provided a push button valve to enable a patient to receive fluids from an overhead suspended container.

Similarly, Metz in U.S. Pat. No. 2,969,064 proposed a drinking tube device with a clamp-like mouthpiece with a unique internal structure that rotated and rocked to dispense fluid when activated by biting.

Similarly Edstrom in U.S. Pat. No. 5,484,405 proposed a drinking device for handicapped persons that had a semi-permanently positioned mouthpiece that was held into position by a stiffener rod, wire, or other material that was affixed to the tube that transmits fluids from the fluid reservoir to the device's mouthpiece.

More complex electronic devices were taught by Turner in U.S. Pat. No. 4,966,580. Here a nipple held on the patient's tongue has a sensor that, in response to the patient's sucking the nipple or pressing the nipple, sends an electronic signal to a peristaltic pump to pump fluids into the patient's mouth.

Despite these and other prior art proposals, none of these devices has apparently been successful enough to catch the attention of the medical community. Even recent review articles, such as "A guide to enteral access procedures and enteral nutrition" O'Keefe, s. J. D. Nat. Rev. Gastroenterol. Hepatol. 6, 207-215 (2009) show that clinician's primarily view enteral administration as either traditional utensils, more heroic interventions such as nasogastric feeding tubes, and not much else. Thus improved methods of enteral fluid administration that fall somewhere in-between a traditional cup and a nasogastric tube would be medically useful.

In applicant's previous disclosures, such as U.S. patent application Ser. No. 13/347,274 and U.S. provisional application 61/431,309, the complete contents of both are incorporated herein by reference, applicant taught a device and method for these purposes. Specifically applicant taught a device and method for enterally hydrating a patient, such as a paralyzed or limited upper body mobility patient with a functional gastrointestinal system who is nonetheless incapable or not fully capable of drinking unassisted. In these disclosures, applicant taught that fluids may be provided by a suspended flexible or semi-flexible container with graduation markings to allow for convenient estimation of fluid use, an upper open and closeable cap to allow the container to be refilled, and a lower fluid conducting tube that terminates in a mouthpiece, which contains a fluid valve formed from at least one slit in an elastic material (e.g. valve material). Patient mouth force on the valve material causes the slit to enlarge, thus enabling fluid to flow into the patient.

U.S. patent application Ser. No. 13/347,274 and 61/431,309 utilized the concept that although the previously discussed complex fluid valves from prior art medically related designs have generally proven not to be successful, more recently, the sporting equipment world has come up with a number of both simple, low cost, yet highly effective fluid valves to enable athletes to drink without using their hands or arms while running, cycling, hiking, and the like.

For example, Fawcett, In U.S. Pat. No. 5,085,349 disclosed a "resilient valve and dispensing system for bicyclists" that is both simple and robust. Further, Cascade Designs Inc., of South Seattle Wash. produces a platypus mouthpiece that is also simple and robust (see, for example, Getzewich "Bite Valve for Personal Hydration Devices and a Method for Making the Same", US publication number 2002/0011583; and Lerner, "Dispensing Valve for a Flexible Liquid Container", U.S. Pat. No. 5,730,336. Other sporting equipment organizations, such as Camelbak Products, LLC, Petaluma Calif. also produce simple and robust fluid valves which may potentially be useful for these purposes as well.

Thus U.S. patent application Ser. No. 13/347,274 and 61/431,309 were based, in part, on the insight that the way to move forward in the field of patient enteral hydration techniques was to develop a more modern patient self-administered enteral device based various state-of-the art methods in plastics and fluid valve technology.

The work of Ser. No. 13/347,274 and 61/431,309 was also based, in part, on the insight that what was needed is a new type of hydration device that configured somewhere between an IV bag on the one hand, and a sports/fitness like personal hydration system (e.g. CamelBak™, Platypus™ etc).

BRIEF SUMMARY OF THE INVENTION

As per previously discussed U.S. patent application Ser. No. 13/347,274 and 61/431,309, the present invention is also based, in part, on the insight that at least some of the problems with prior art enteral fluid administration schemes is caused by the fact that the earlier devices had generally not adequately solved the fluid valve problem in the patient's mouthpiece. Some sort of well functioning mouthpiece fluid valve is needed in order to regulate fluid flow, delivering fluid when the patient wants it, and promptly shutting off when the patient is done drinking.

Additionally, however, the present disclosure is based, in part, on the additional insight that it is further desirable to provide such patients with enteral fluids that have been cooled below room temperature, such as in the 4.degree. C. to 15.degree. C. range. This may be done, by for example modifying the devices and methods of Ser. No. 13/347,274 and 61/431,309 to additionally provide for fluid containers that have flexible pouches designed to both accommodate cooling material (such as ice), as well as to press the cooling material up against the fluid storage portion of the container (while keeping the cooling material separate from the fluid) so that the cooling material may act to cool the fluid either before, or during, the time when the patient is drinking.

In some embodiments, the device may be optimized for use in medical aseptic techniques intended to reduce patent exposure to external (e.g. hospital) microorganisms in environments outside of the operating room. In such embodiments, the device may be a non-refillable container that, for example, may be factory pre-filled with drinking fluid and then either sterilized, or otherwise treated to reduce the microbial load, prior to administration to the patient.

Various modifications and alternate embodiments of such devices and methods are also described herein.

BRIEF DESCRIPTION OF THE DRAWINGS

FIG. 1A depicts the Discovery Cohort intra-subject and inter-subject analyses as discussed in Example 1.

DETAILED DESCRIPTION OF THE INVENTION

In this disclosure, first the devices and methods of application Ser. No. 13/347,274 and 61/431,309, which are often applicable to the present disclosure's devices and methods, will first be reviewed. Unless otherwise specified, these devices and methods may be used for the purposes of the present disclosure as well.

Figure 1:
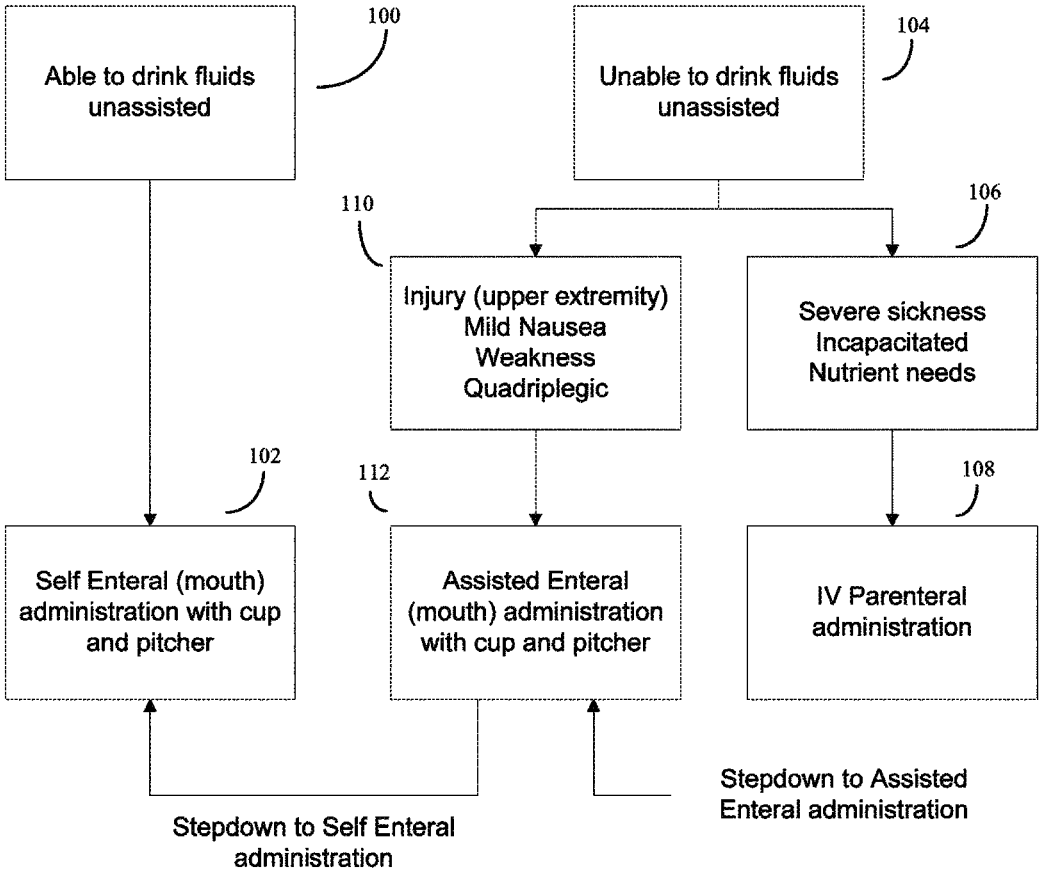
Figure 1 Prior art
FIG. 1 shows a flow chart of the hydration decision tree and hydration options generally used for patient hydration management.

FIG. 1 shows a flow chart of the hydration decision tree and hydration options generally used for patient hydration management. At present, if a patient is able to drink fluids without outside assistance (100), then absent other reasons to give the patient an IV, the patient will normally obtain most fluids by simply drinking out of a cup (102), with the water or other beverage refreshed by a pitcher or other bottle as needed. A fair number of patients, particularly patients in clinical settings such as hospitals, rehabilitation facilities, hospices and the like are unable to drink unassisted however (104). Some of these patients may be so severely sick (i.e. major gastrointestinal issues, in intensive care, need IV administration for high dose chemotherapy, and the like (106) that they must be hydrated by IV (108).

There is also an intermediate range of patients (110) that have adequately functioning gastrointestinal systems (here adequate means capable of absorbing sufficient fluid to adequately hydrate the patient) who have other problems that prevent them from adequately self hydrating. They may be too weak, suffer from paralysis or other loss of upper body mobility (here simply having both arms in casts might be sufficient), or other problem that prevents them from self administering fluids. At present, prior inventions in the area notwithstanding, the solution is to generally throw a lot of resources at the problem by designating a nurse, nurse assistant, or family member to stand by and administer fluids (112). This is both costly, and can create gaps where the patient is awake but uncomfortable due to thirst.

By contrast, through use of the invention's device and methods, compliance with the prescribed therapeutic hydration regimen becomes both logistically similar and more reliable.

Whenever possible, clinicians attempt to step the patient down to normal hydration methods as quickly as possible.

Sometimes patents can be stepped down from IV administration (108) directly to self administration with a cup (102) directly. At other times, patients will initially start with assisted administration with, for example a cup (112) and step down to self administration with a cup (102) when ready. At still other times, a patient may need to step down twice—once from IV administration (108) assisted cup administration (112), and then again to the normal self cup administration (102). The invention is based in part on the insight that there remains room for improvement at the assisted cup administration stage (112).

Figure 2:
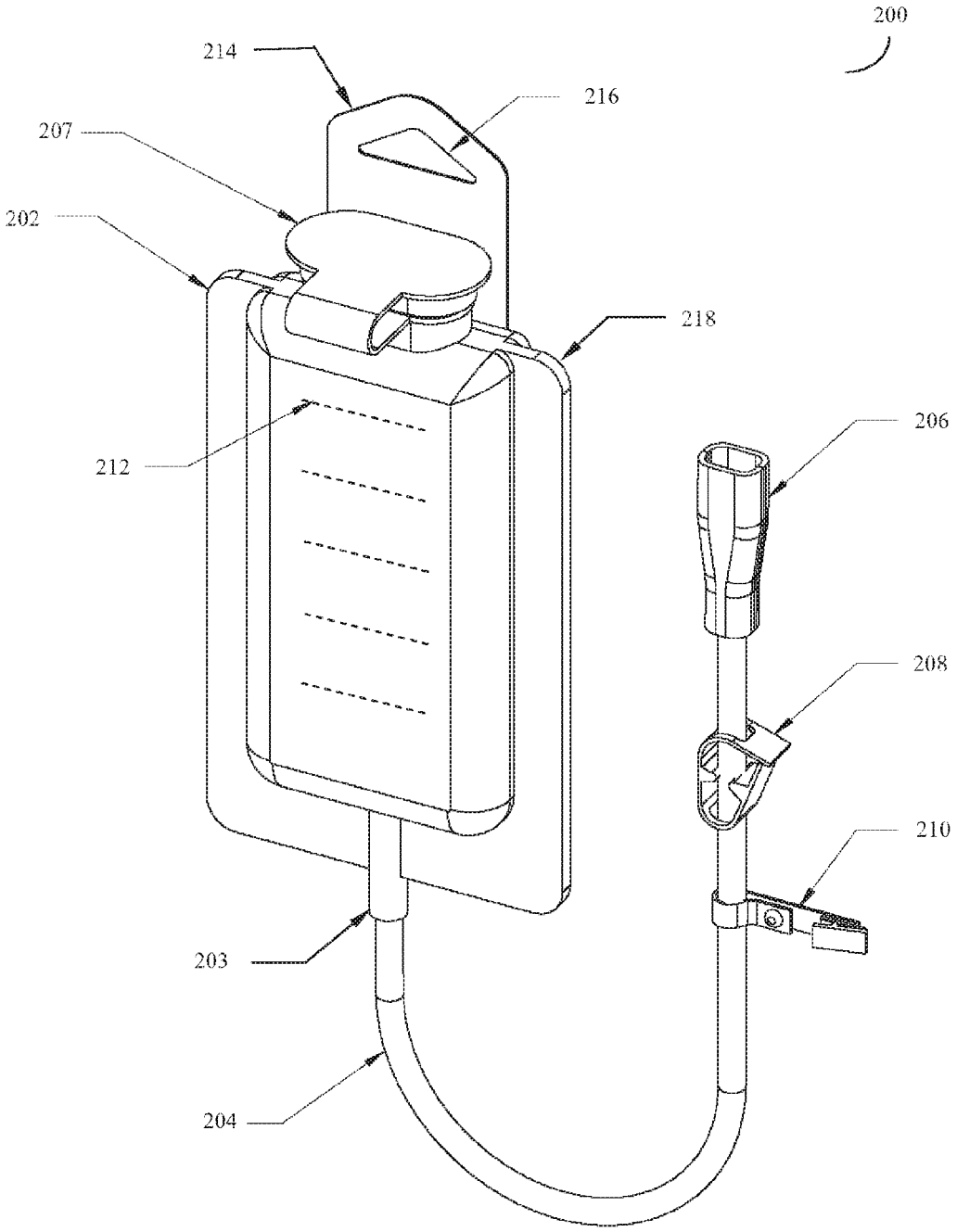
FIG. 2 shows an overview of the patient enteral hydration device, but without the cooling pouch.

FIG. 2 shows an overview of the patient enteral hydration device (200) without the cooling pouch option. The cooling pouch will be shown in more detail in FIG. 10.

In particular, in one embodiment, the invention may be a both a device and a method of enterally hydrating a patient, such as a patient in need of assisted enteral fluid administration (112).

Here, the device and method will often work by providing a substantially transparent fluid container (often plastic) (202) which will usually have several soft deformable sides (such the flexible soft and deformable sides of an IV bag), but which in some embodiments may also have at least one substantially non-deformable side. In other embodiments all sides may be flexible and deformable. The top side of this fluid container may be at least in part be substantially rigid or at least have a substantially rigid portion, often with a one-piece rigid or semi-rigid press-clamp cap (207) configured to either open to admit fluids into the container, or to securely snap shut.

The back side of the fluid container will often be mounted on (or by itself) a back support (214), optionally (218). This back support, which optionally may be substantially flat, will generally extend above the level of the cap, and will often have a fenestrated opening (e.g. a hole in the back support material 216) that is also above the level of the cap (207). The hole or fenestration in the back support (216) will usually also extend above the cap, and this hole will usually be disposed to enable the container to be suspended from an IV pole or other support structure. As will be discussed, in some embodiments this back support may serve as one side of a cooling pouch (i.e. pouch used to hold a cooling material) as well.

The lower portion of the fluid container will generally have a lower opening with either a tube adapter (203) connected to the distal opening of a hollow tube, or alternatively a directly connected hollow tube (204). This hollow tube (204) will be made of a material (often plastic as well) selected for transporting fluids for human consumption, and will generally be long enough (e.g. 2 to 20 feet) to deliver fluid from the fluid container (while suspended near the patient) to the patient's mouth. At the patient's mouth end, the hollow tube will have a mouthpiece (206) attached to the proximal opening of the hollow tube (204).

As will be discussed in more detail in FIGS. 6A and 6B, this mouthpiece (206) that connects to the tube (often via a coupling region (612)) will generally be configured with at least a fluid valve (602) comprising at least one narrow slit (604) in an elastic and deformable surrounding material (606). In some embodiments, this fluid valve may be further encased in an outer covering or shell (608), (610) as well. In the absence of patient mouth generated force (e.g. sucking, biting), this deformable material (606) will hold the slit (604) shut, thus preventing fluid flow. However in the presence of patient mouth generated force (e.g. sucking, biting), said deformable material (606) deforms thus causing the slit (604) to enlarge and permitting fluid flow from the container into the patient's mouth. Here, the materials and methods of Fawcett (U.S. Pat. No. 5,085,349) may be used, and these materials and methods are incorporated herein by reference. Other methods (previously discussed) may also be used.

To use the device/method, the container will first be filled with fluid (e.g. water, or alternatively water supplemented by various combinations and permutations of salts, nutrients, flavoring agents, therapeutic agents, and the like). Although in some embodiments the container will lack a cap, and be pre-filled at the factory, in many embodiments the container will be a reusable container that is filled by opening the press-clamp cap (207), filling the fluid container with fluid, and closing the press-clamp cap. Alternatively before, after, or during this step, the container will be mounted on a support structure (e.g. IV pole) by placing some support member through the fenestrated opening (216). This is shown in more detail in FIG. 7. After this, the tube and mouthpiece can be provided to the patient (e.g. clipped to a convenient location where the patient can easily access) and as needed, the patient can be instructed on what sort of mouth force is best to use the device.

A variety of different types of container designs may be used. In some embodiments, containers that have a semi-rigid or rigid back (214), optionally (218) may have some advantages in that they provide some structure and support to the container even when it is empty, thus making for more accurate fluid measurements as well as increased ease of handling. However this is not always required.

At the same time, although one or more sides of the container may be rigid in some embodiments, often it is useful to have the front of the container (e.g. the side with graduations (212)). as well as the container sides connecting to the optionally semi-rigid or rigid back, be flexible so that they deform outward in response to fluid, and deform inward in response to loss of fluid. This as the container is drained of fluid, the cap (207) can maintain a tight seal, while at the same time a vacuum will not form inside the container (because the container walls will move inward as fluid is depleted), making it uniformly easy for the patient to obtain the fluid, as the fluid levels drop, without any admixture of air or outside contaminants.

In some embodiments, it may be useful to further have a thumb controlled tubing clamp (208) or other secondary fluid shutoff configured to provide an independent shut-off for stopping fluid flow along the hollow tube (204). Additionally, in some embodiments, it may also be useful to have a clip (210) attached to either the tube or the mouthpiece and configured to at least temporarily fix the mouthpiece to a location near the patient's mouth.

In some embodiments, it may be useful to have at least parts of the top of the container where the cap is located be formed, at least in part, from a relatively rigid material so that the cap has a complementary port to clip on to that will maintain its rigidity and fluid tightness between both full and empty states. Usually it is also useful to make some of the sides of the container, and preferably all of the sides of the container out of a transparent material so that the level of fluid in the container can be easily determined by sight.

Figure 3A:
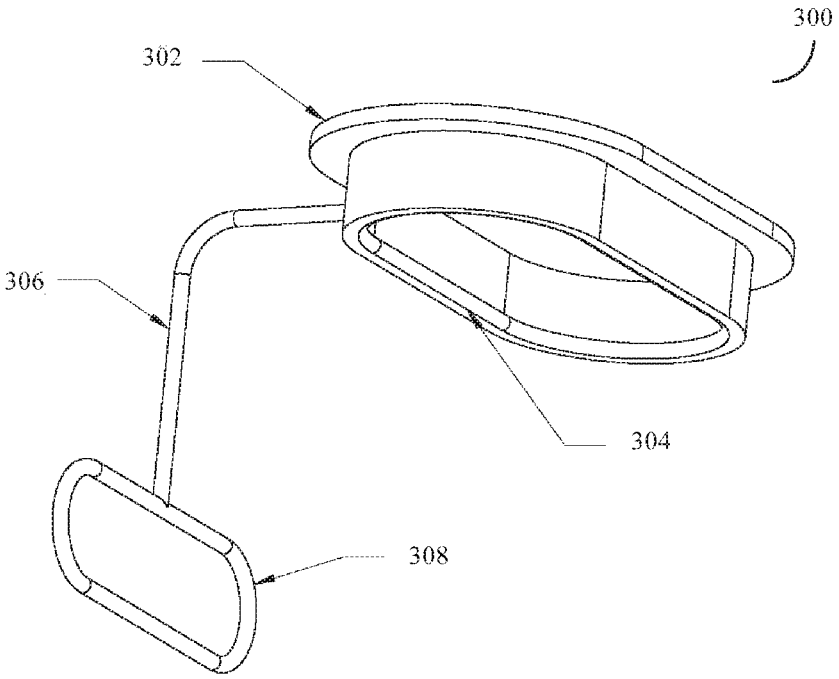
FIG. 3A shows a close up of one embodiment of the devices' snap-on cap.

FIG. 3A shows a close up of one embodiment of the devices' snap-on cap assembly (207), here showing one cap design (300). This cap has a flanged edge (302) to provide a good hand grip for opening and closing, an inner ring to snap onto the cap's complementary edge (304), a thin hinged region (306) and a plastic ring (308) to keep the cap adhered to the cap's complementary edge.

Figure 3B:
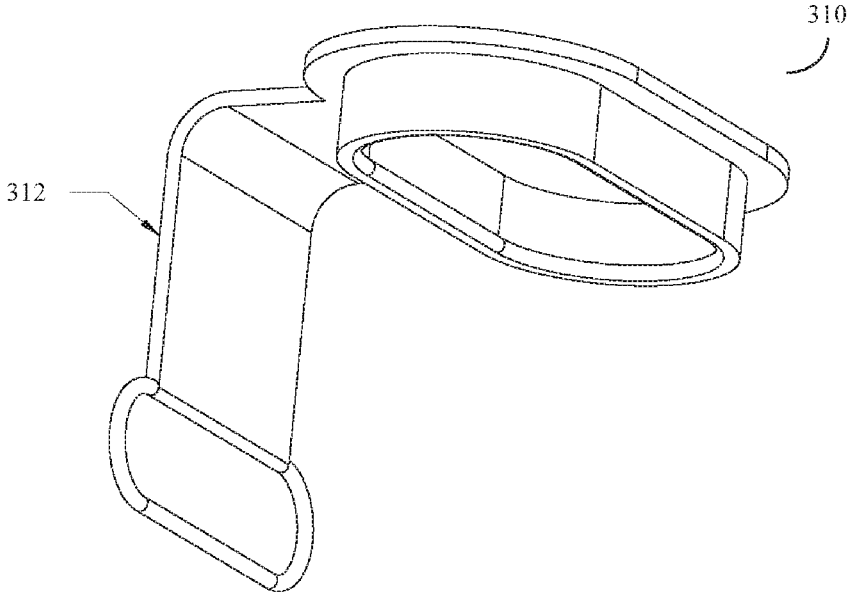
FIG. 3B shows a close up of an alternative embodiment of the devices' snap-on cap.

FIG. 3B shows a close up of an alternate embodiment of the cap (310) where the hinged region is appreciably wider (312).

Figure 4A:
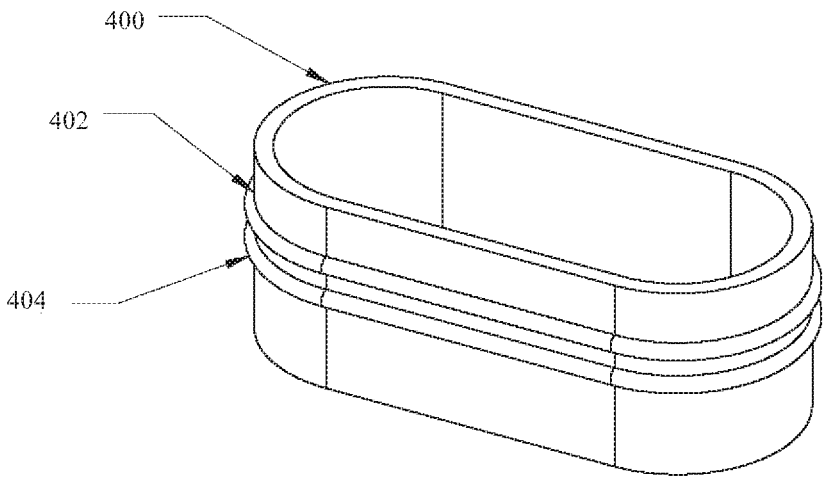
FIG. 4A shows a close up of the complementary edge of the device's snap-on cap.

FIG. 4A shows a close up of the complementary edge (400) of the device's snap-on cap. This will usually be made of rigid or semi-rigid material so as to create a good fluid barrier. This complementary edge may optionally have one or more grooves or detents (402), (404) designed to match up and interlock with corresponding grooves or detents in the cap.

Figure 4B:
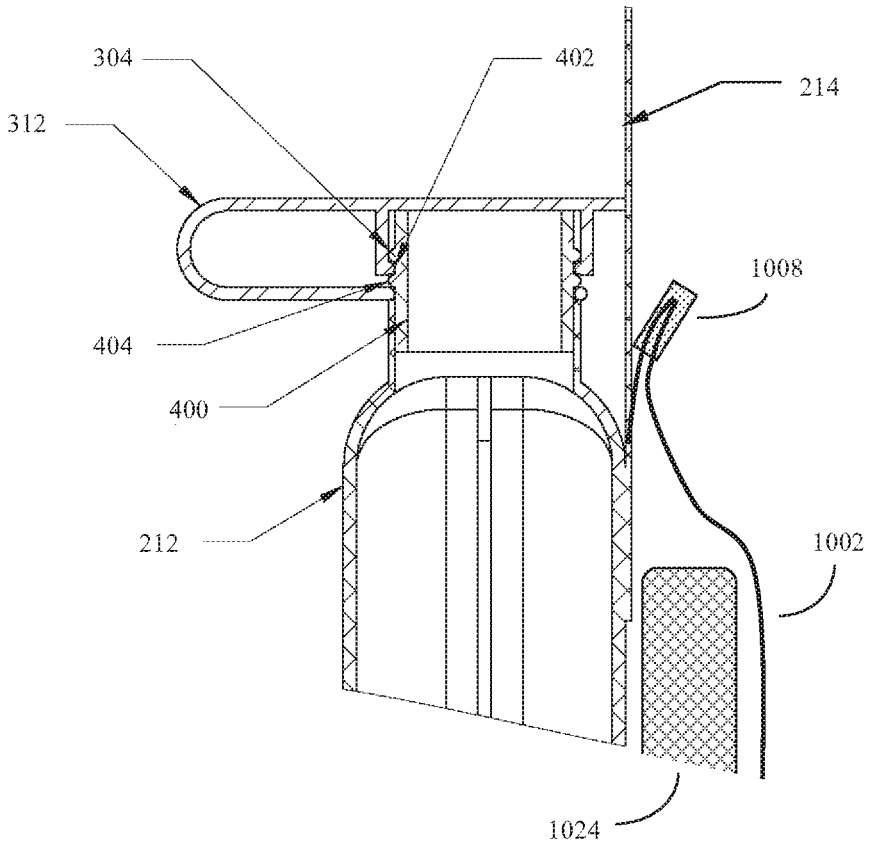
FIG. 4B shows a cross sectional view of the snap-on cap in the shut position.

FIG. 4B shows a cross sectional view of the snap-on cap (207), (310) in the shut position.

Figure 7:
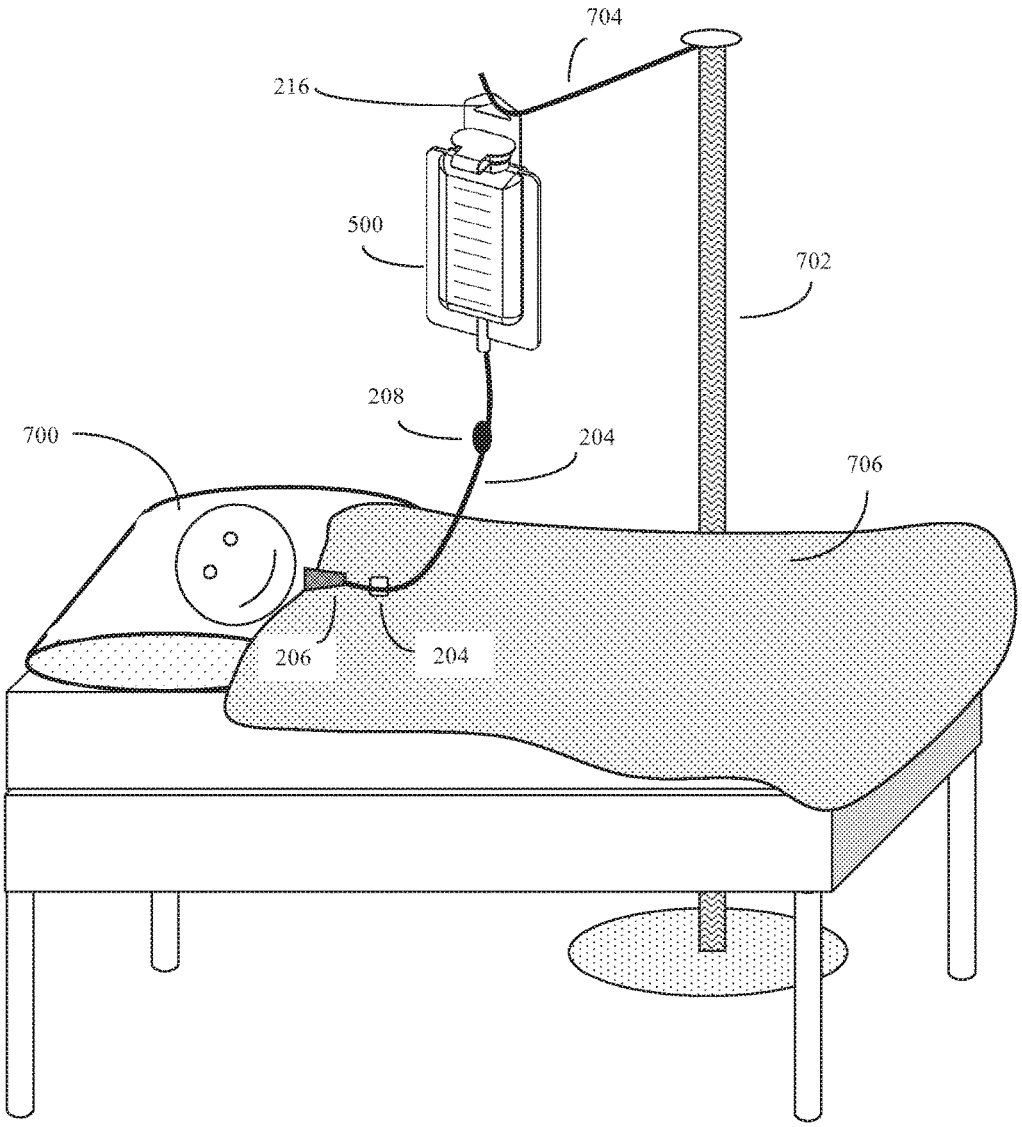
FIG. 7 shows an example of the device (here without the cooling pouch) in use hydrating a patient.

As previously discussed, the back side of the fluid container may be either mounted on, or directly comprise a substantially flat back support (214) with a fenestrated opening (216) extending above the cap (204). This fenestrated opening may be configured to allow the fluid container to be suspended from an IV pole or other support structure, as is shown in FIG. 7.

Jumping ahead briefly to the newer material in the present disclosure, FIG. 4B also shows an example of the optional pouch formed from pouch second side (1002) and the pouch first side/support structure (214). The clipping mechanism (1008) and cooling material (1024) are also shown in cross section. This will be discussed in more detail in FIGS. 10 and 11. Note that in this example, support side (214) also has a separate lip or flap to facilitate pouch closure.

Figure 5:
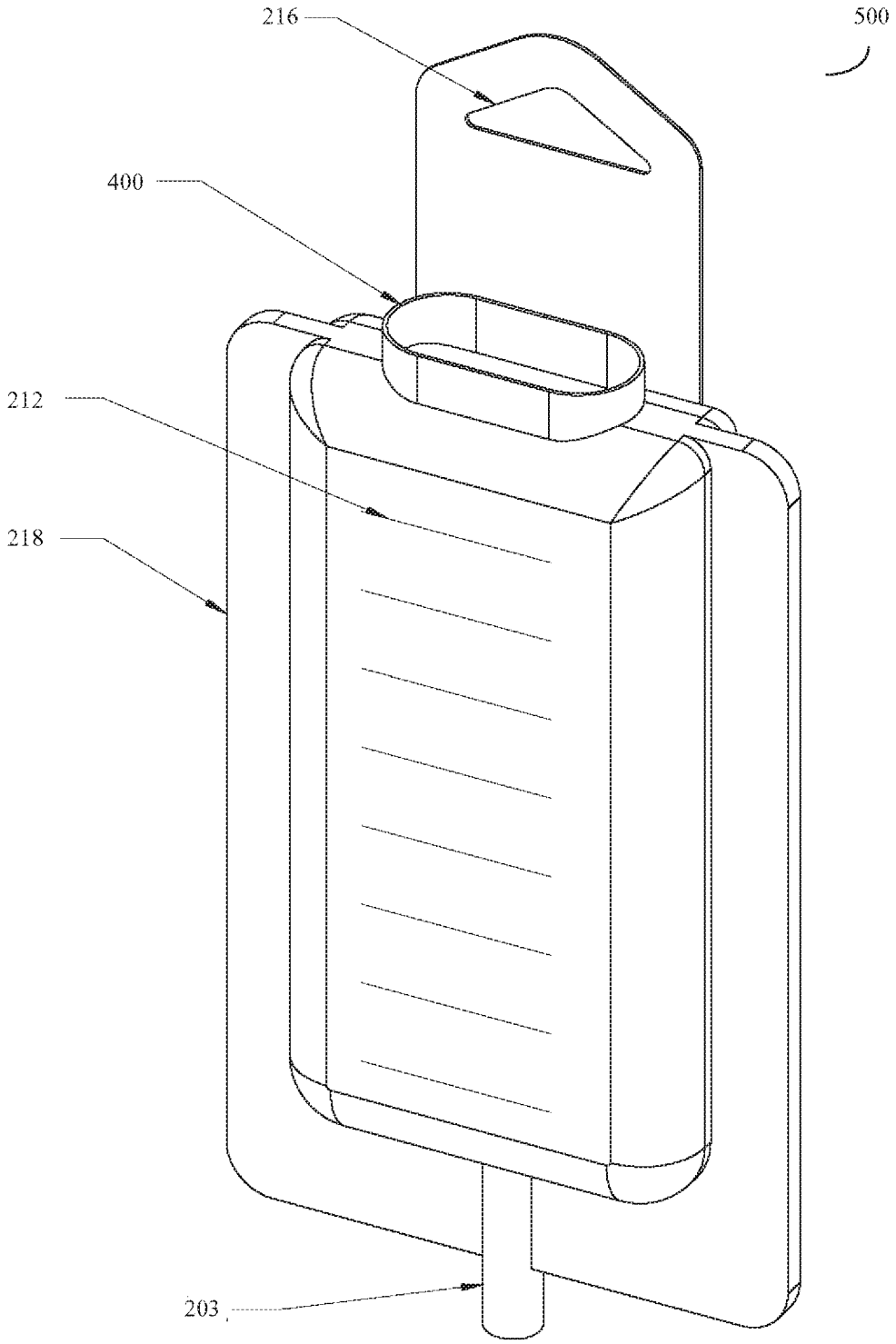
FIG. 5 shows a view of the device's fluid reservoir and fenestrated opening.

FIG. 5 shows a closer view of the device's fluid reservoir and fenestrated opening (without the cooling pouch). As previously discussed, the fluid container (500) will often have a lower opening with either a tube adapter connected to the distal opening of a hollow tube (203), or a directly connected hollow tube. This hollow tube, previously shown in FIG. 2 as (204), will generally have sufficient length to deliver fluid from the fluid container (500) while the container is suspended near said patient, and deliver this tube to the mouthpiece (206).

Figure 6A:
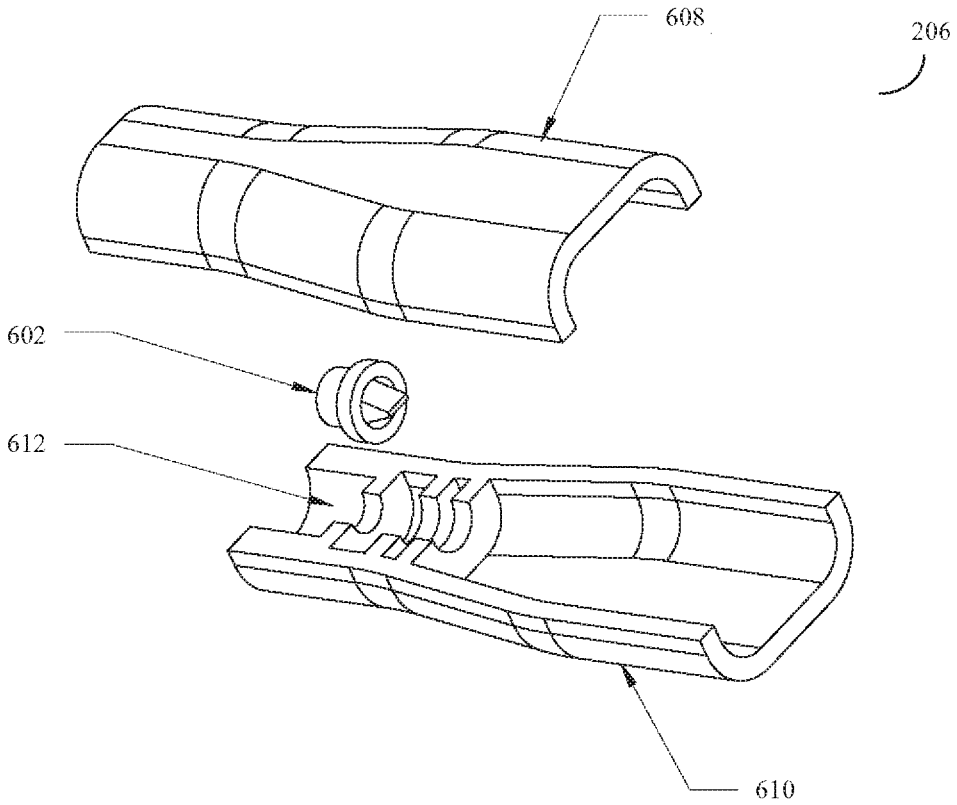
FIG. 6A shows an overall view of the device's mouthpiece.
Figure 6B:
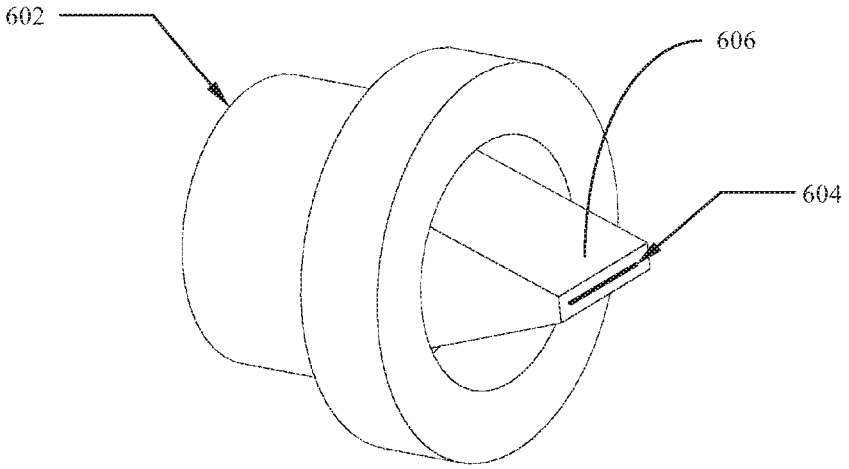
FIG. 6B shows a close up view of the device's valve.

FIG. 6A shows an overall view of the device's mouthpiece, and FIG. 6B shows a close up view of the device's valve. As previously discussed, this mouthpiece (206) that connects to the tube (often via a coupling region (612)) will generally be configured with at least a fluid valve (602) comprising at least one narrow slit (604) in an elastic and deformable surrounding material (606). In some embodiments, this fluid valve may be further encased in an outer covering or shell (608), (610) as well. In the absence of patient mouth generated force (e.g. sucking, biting), this deformable material (606) will hold the slit (604) shut, thus preventing fluid flow. However in the presence of patient mouth generated force (e.g. sucking, biting), said deformable material (606) deforms thus causing the slit (604) to enlarge and permitting fluid flow from the container into the patient's mouth. Here, the materials and methods of Fawcett (U.S. Pat. No. 5,085,349) may be used, and these materials and methods are incorporated herein by reference. Other methods (previously discussed) may also be used.

Thus in this particular embodiment, in the absence of patient mouth generated force, the deformable material (606) holds the slit (604) shut, thus preventing fluid flow to the mouth of said patient. However when the patient wants fluid, and communicates this by sucking on the mouthpiece or biting on the mouthpiece, this deformable material deforms thus causing the slit to enlarge and permitting fluid flow to the patent's mouth.

FIG. 7 shows an example of the device in use hydrating a patient (700). In this example, the container (500) is hanging from an IV pole (702) support (704) by way of opening (216). The mouthpiece (206) in this example is clipped to the patient's blanket (706) in a region near the patient's mouth by a clip (210). The cooling pouch option is not shown here.

Figure 8:
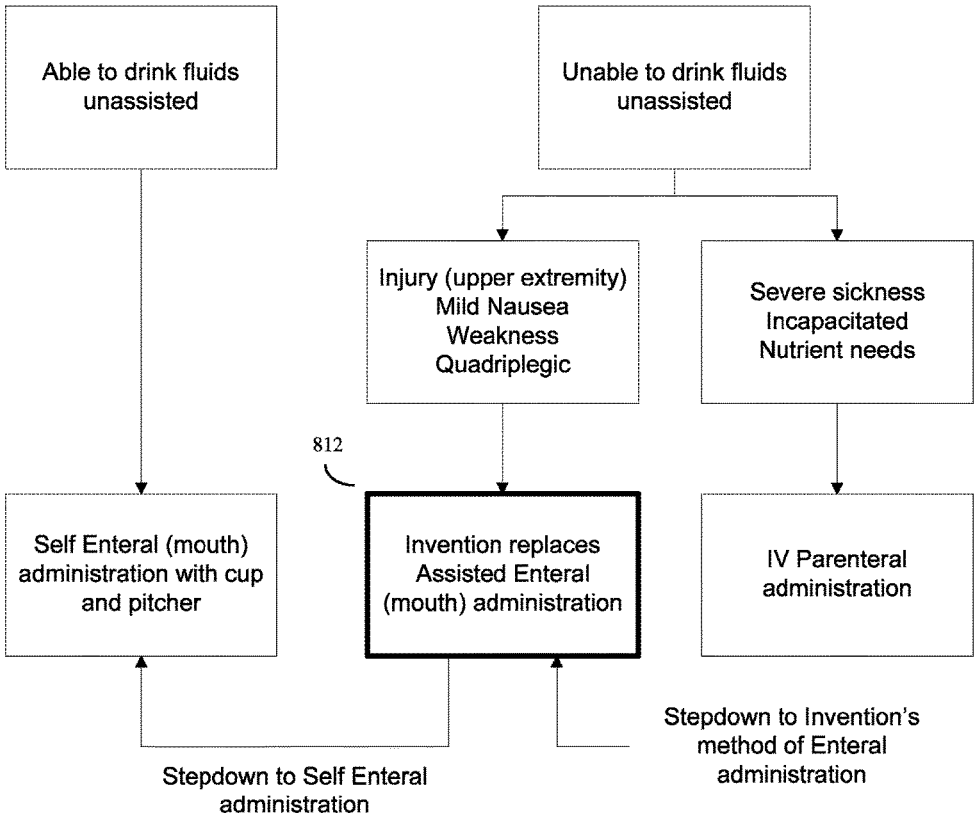
FIG. 8 shows a flow chart of the hydration decision tree and hydration options generally used for patient hydration management, when using the invention.

FIG. 8 shows a flow chart of the hydration decision tree and hydration options generally used for patient hydration management, when using the invention. Here the considerations are generally similar to those previously described in FIG. 1, however now with the use of the invention, what was formerly a very labor intensive assisted enteral fluid administration step (112) now is greatly labor reduced because the invention's device and methods are now used in (812). Indeed, the invention reduces the amount of effort required for the patient to self-administer fluids to the point where some patients may wish to continue using it even after they regain the ability to use a cup.

Here, the invention's use on a non-obligatory basis (i.e. use by patients capable of self enteral administration) can be as policy and costs dictate. For example the invention's device and methods could be useful in pediatric or geriatric wards where patients can drink with a cup, but may be unacceptably messy while doing so. Thus the invention can reduce clutter and traffic around the patient, help prevent fluid spills, and allow for fluid intake by ambulatory patients.

The device will most commonly be made from one or more plastics. Here the plastics will often be selected from the group of transparent polymers generally recognized as suitable for fluid storage and transport in a medical setting. This can include polyethylene, polypropylene, polyvinyl chloride (PVC), Polyolefin, Thermoplastic elastomers, and the like.

Figure 9:
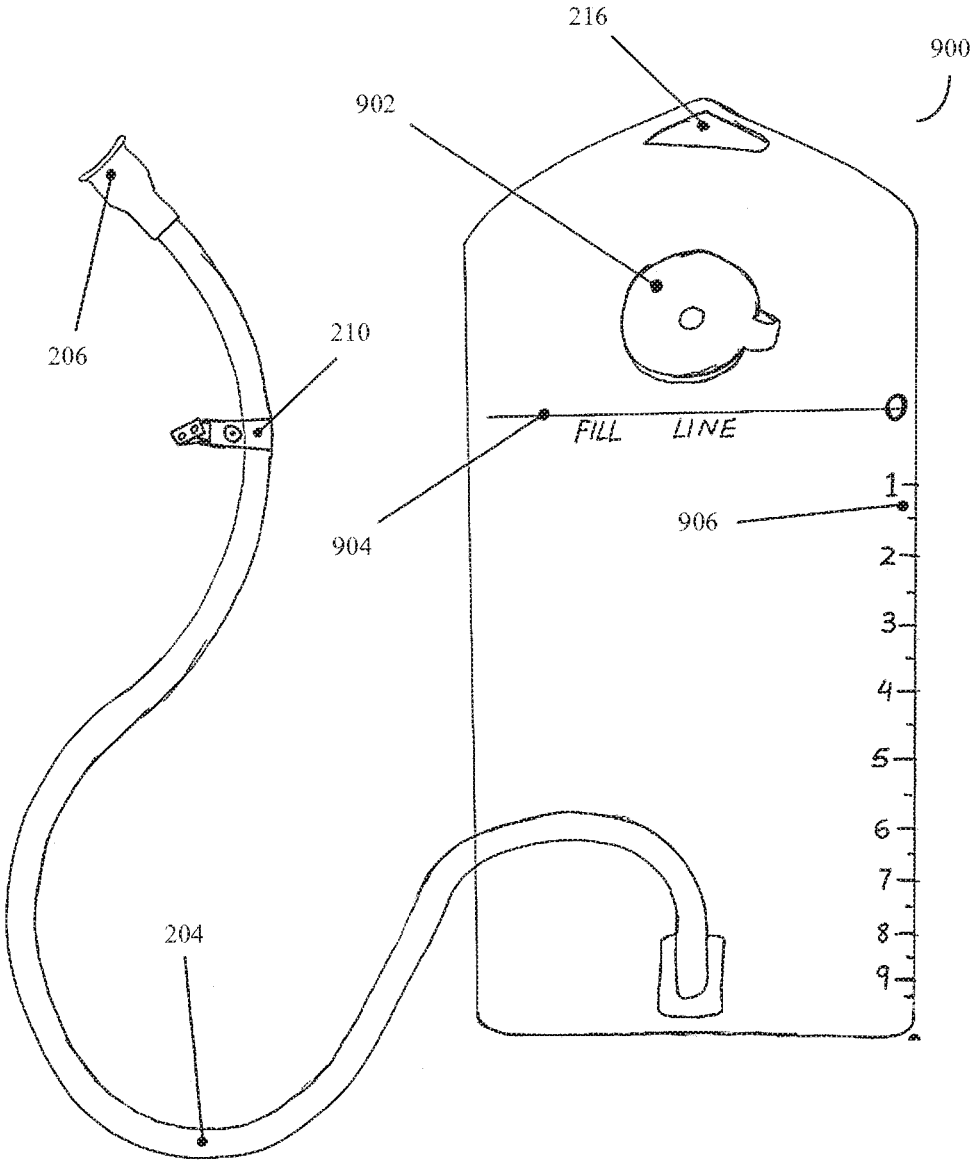
FIG. 9 shows an alternate embodiment of the invention's fluid container, again without the cooling pouch option.

FIG. 9 shows an alternate embodiment of the invention's fluid container. In this embodiment, the entire body of container (900) is made from a flexible and deformable material. The cap (902) is smaller and circular. There are also separate fill line (904) and graduation (e.g. volume) markers (906). The back may optionally be made from a non-deformable material.

In other embodiments, as previously discussed, the container may be a non-reusable container that may lack such a cap altogether. Here often it will be useful to, for example factory fill the container and either sterilize the fluid contents, or at least treat in a manner to reduce the microbial load in the fluid and at least the interior of the container, prior to use by the patient.

Such embodiment are particularly useful for medical aseptic techniques intended to reduce patent exposure to external microorganisms, such as hospital, hospice, nursing home, home or other clinic environments outside of the operating room.

Devices and Methods to Provide Cooled Fluids

As previously discussed, in one embodiment, the invention may be a method of enterally hydrating a patient with a cooled fluid. This cooled fluid may be water, or water supplemented by various salts, nutrients, and other therapeutic agents. As previously described, this method will also be based on using or providing fluid container, often a substantially transparent fluid container. This fluid container will have a plurality of different sides, where some or even all of these sides may be substantially deformable. Generally most of these sides will be attached to each other by various mechanisms, including heat sealing, adhesive lamination, and other methods.

To provide cooling capability, at least one of the sides of the container may comprise at least a portion of a side of a pouch. This pouch will generally be configured to receive and hold a cooling material against another side of the container that also serves as a side of the container that also holds fluid, but the container and pouch are also configured so that the cooling material does not come into direct contact with the fluid.

In some embodiments, at least one side of the fluid container (support side) may also be used to support the entire container. To do this, this support side will have an opening (fenestrated opening) configured to allow this fluid container to be suspended from an IV pole or other support structure. Although in principle, any side of the fluid container may be used to support the entire container, in a preferred embodiment, it may be useful to use the side of the fluid containing portion of the container that also serves as one side of the pouch for these purposes. This support side may be rigid, semi-rigid or flexible (deformable), but in some embodiments may be made stronger than the other sides in order to accommodate the extra stress of acting as a support structure.

In order to facilitate administration of fluid to the patent, the fluid container will generally also further have a lower opening with either a tube adapter connected to the distal opening of a hollow tube, or a directly connected hollow tube. This hollow tube will generally have sufficient length (e.g. two to 10 or even up to 20 feet) to deliver fluid to the patent from the fluid container, while the fluid container is while suspended near the patent. The tube will deliver the fluid to a hollow tube connected mouthpiece attached to the proximal opening of this hollow tube. This mouthpiece will often be configured with a valve. This valve will comprise at least one narrow slit in an elastic and deformable valve material.

The valve function is generally such that in its resting state, which is in the absence of patient mouth generated force, the deformable valve material will hold this slit shut, thus preventing fluid flow. However in the presence of patient mouth generated force, this deformable valve material will deform, thus causing the slit to enlarge and permitting fluid flow.

There are generally two types of fluid container possible. In one configuration, the fluid storage portion of the fluid container is generally non-refillable in that it does not have a cap. Instead the fluid storage portion will be filled with the fluid at the factory or other assembly site prior to use. In another configuration, the fluid container will have a cap assembly, such as the cap assemblies previously described, allowing the container to be refilled multiple times as desired.

To provide the desired fluid cooling, the operator of the device will generally place a cooling material, such as ice, into an opening (usually the top opening) of the pouch. Then, either before or after the cooling material is placed in the pouch, the fluid storage portion of the fluid container will be filled with the fluid. Once the cooling material comes into contact with the fluid, the fluid will become cooled by the thermal transfer of heat across the common side between the fluid storage portion of the container and the pouch.

In addition to ice, other cooling materials may be used. These may consist of various cooling packs or cold packs such as cool packs, ice packs, gel packs, instant cold packs and the like. Indeed in some cases where it is desirable to instead provide the patient with warmed fluid, the "cooling material" can be generalized to also include various types of hot pack that alternatively warms the fluid instead.

In use, either before or after the fluid and cooling material has been loaded, the operator will mount the container on a support structure using the fenestrated opening. The operator will generally also provide the tube and mouthpiece to the patient, and instruct the patient to apply mouth force when cooled fluid is desired. In some cases, of course, the operator and the patient may be the same person, and/or the patient may already know how to use the device, in which case subsequent reiteration of the instructions is not needed, and this "instruction" language is not intended to be limiting in this regard. That is an initial instruction by an operator, or even written instruction is adequate for these purposes, and this "instruction" does not have to be literally repeated each time if it is not needed.

The pouch may be implemented by various structures and methods. In one embodiment, the pouch may be formed from a first and a second pouch side. These sides may be stuck together (by temperature/pressure lamination, adhesive, or other process) to form a pouch structure. This pouch structure will generally have an open pouch top (here "top" and "bottom" are defined with respect to gravity when the container is suspended on an IV pole as per FIG. 7), as well as laminated pouch sides, and a laminated pouch bottom. Thus for example, in the case when the cooling material is ice, the pouch will continue to hold water from the melted ice, and keep this separate from the fluid for the patient, even after the ice has melted.

To facilitate cooling, the at least a portion of one side of the pouch (here called the "first side") will also form a side of the fluid containing portion of the container as well. This helps facilitate heat transfer between the cooling material and the fluid in the fluid containing portion of the container. The pouch will also have a second side, again generally attached to the first side, generally at the edges or near the edges of both sides. To provide room for the cooling material (e.g. to give the pouch some holding volume, the second side of the pouch will often be made of a deformable material, and will also generally have a surface area that is sufficiently larger than the first side so as to provide sufficient volume, when extended, to accommodate the cooling material. Generally this volume will be some fraction of the volume of the fluid containing portion of the container, such as 200%, 100%, 50%, or 25% of the volume of the fluid containing portion of the container.

Once the cooling material, such as ice, has been placed in the pouch, in some embodiments it may be desirable to then close or seal the top of the pouch to prevent accidental spillage of the cooling material. This can be done by various methods. Here, it is often useful to take advantage of the fact that the top portion of the pouch first side and the top portion of the pouch second side can be configured to form a flap. This flap in turn may be both opened and closed (sealed). Although various sealing mechanisms are possible, in some configurations a clamping mechanism such as a clip may be disposed on or near the flaps. This clamping mechanism may be disposed to allow flap to be sealed. This will generally be done after the cooling material has been inserted into the pouch. If the container is a one-time use container, the clamping mechanism can be a one-time use mechanism, but if the container is intended for multiple uses (i.e. has a cap allowing the fluid to be refilled) then the clamping mechanism may be configured to allow multiple rounds of pouch sealing and unsealing. The clamping mechanism may either be permanently attached to the container (e.g. mounted on a hinge, or connected by a flexible connector), or it may be detachable from the container.

Put alternatively, in some configurations the invention may also be a device for enterally hydrating a patient with a cooled fluid. As previously discussed, this device will generally comprise a fluid container, often a substantially transparent fluid container, again comprising a plurality of sides. At least some of these sides (often the front of the fluid containing portion of the container, and the back of the pouch) will be substantially deformable. As previously discussed at least one of these sides will further form at least a portion of a side of a pouch. This helps configure the pouch to first receive the cooling material, as well as then hold the cooling material against at least one side of the fluid containing portion of the fluid container.

As previously described, the pouch will generally be formed from first and second pouch sides, generally laminated or otherwise sealed together at most of their edges to form a pouch structure with an open pouch top, laminated pouch sides, and a laminated bottom, where again "top" and "bottom" is with respect to the direction of gravity when the pouch is suspended as per FIG. 7.

Thus in general, at least a portion of the first side of the deformable pouch portion of the container will thus also form a side of the fluid containing portion of the container. However another portion of this side may also, for example, protrude above the level of either one or both of the fluid containing portion of the container and the pouch portion of the container, and serve as a support with a hole (fenestrated opening) to suspend the container from an IV pole or other structure.

As previously discussed, the second pouch side will generally be a deformable side that has a surface area sufficiently larger than the first pouch side so as to accommodate the cooling material when the cooling material is inserted into the pouch through the open pouch top. Further, generally at least one side of the container will be mounted on, or comprise a support with a hole (fenestrated opening). This fenestrated opening will be configured to enable the container to be suspended from an IV pole or other support structure.

The container will also comprise a lower opening with either a tube adapter connected to the distal opening of a hollow tube, or a directly connected hollow tube.

Again as previously discussed, the top portion of the first and second sides of the pouch portion of the container are often naturally disposed to form the two sides or lips of a flap type opening, and the top portion of both sides may optionally be extended, contoured, or otherwise configured to facilitate producing such a sealable flap. In particular, to help secure the cooling material in the pouch, the container may also have a clamping mechanism configured to allow the flap to be sealed. Usually this will be done after the cooling material has been inserted into the pouch through the open top and two sides or lips of the flap.

The above container may be sold by itself as a stand-alone product, and used in conjunction with other materials, such as tubes, independently provided by the user. In this case, the invention may be regarded as being simply the combination fluid container/cooling material pouch described above.

In other configurations, however, which also will be more convenient to the user, the above combination fluid container/cooling material pouch may be further configured with a hollow tube with sufficient length (often 2 to 10 or even 20 feet) to deliver fluid from the fluid container to the patient, while the container is suspended near the patient.

This hollow tube will generally be connected, on the proximal or patient side, to a hollow tube connected mouthpiece. As previously discussed, this mouthpiece will often further comprise a valve with at least one narrow slit in an elastic and deformable valve material. This slit and the valve material will be chosen so that in the absence of patient mouth generated force, the deformable valve material will hold the slit shut. This will prevent fluid from flowing to the mouth of the patient. And again as previously described, in the presence of patient mouth generated force, the deformable valve material will deform, thus causing the slit to enlarge and permitting fluid flow to the mouth of the patent.

Figure 10:
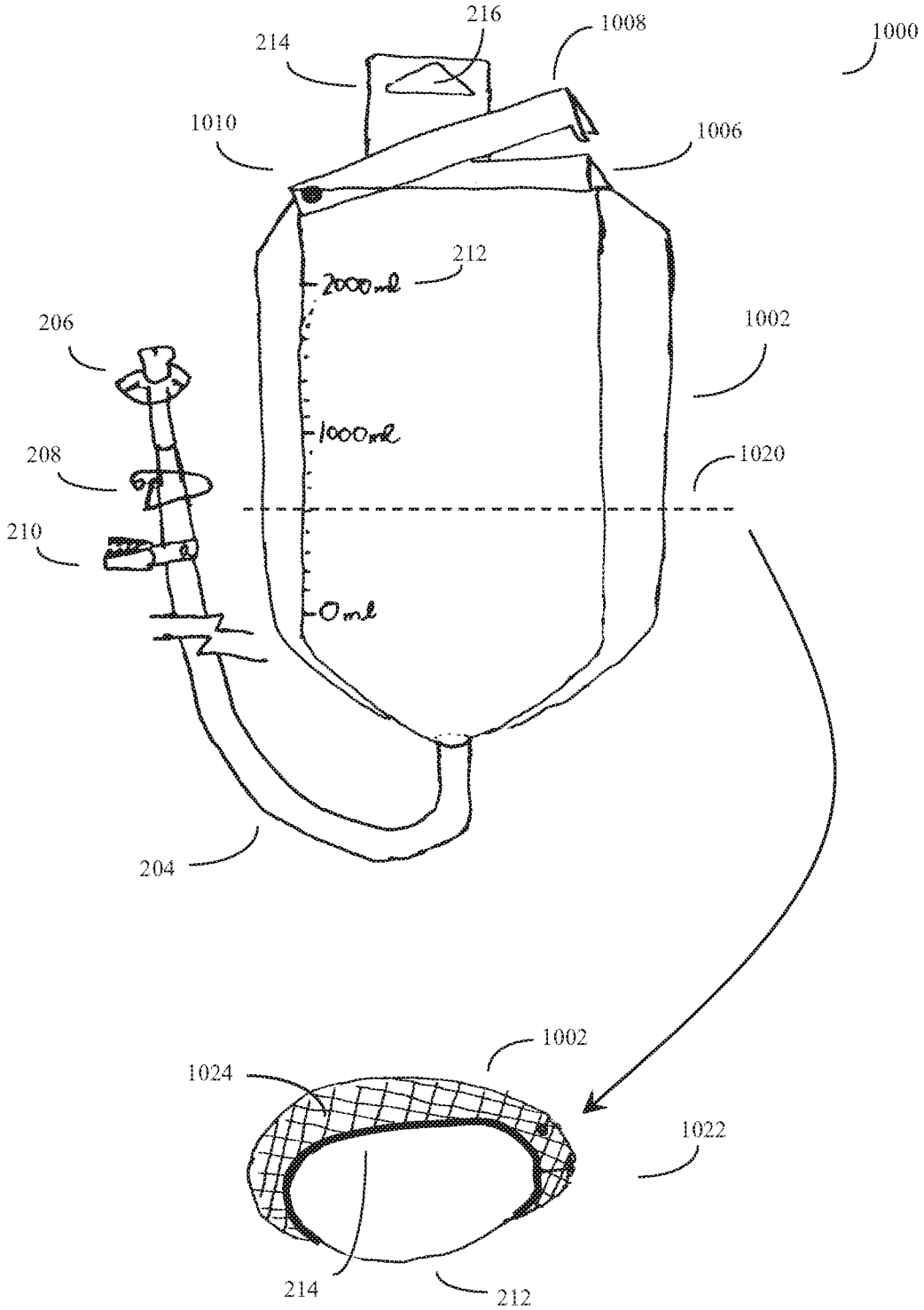
FIG. 10 shows an alternate embodiment of the container, which also shows the invention's cooling pouch mechanism that can be used to hold a cooling material, such as ice, used to cool the fluids.

FIG. 10 shows an alternate embodiment (1000) of the container, which also shows the invention's pouch mechanism that can be used to hold a cooling material, such as ice, used to cool the fluids. In this particular embodiment, there is no cap (207, 902). Rather in this specific embodiment the fluid container is a sealed container that has been factory pre-filled with fluids, and often either partially or fully sterilized before use. As previously discussed, such containers are often useful for practicing medical asepsis methods. Note however, that in some pouch embodiments, the previously described cap arrangements (e.g. 207, 902) may be used.

In this embodiment, the pouch (1002) will often be mounted on one side of the fluid container. In some embodiments, this one side of the container will also comprise the support (214). The pouch (1002) is configured to with at least one deformable side (also 1002) that is laminated or otherwise attached to the side of the fluid container (such as 214). This lamination or attachment will generally be on both sides of the pouch and the bottom of the pouch, but will leave an opening such that when the container is suspended on a support (FIG. 7: 702, 704), then cooling material (1024), such as ice, that is placed into the pouch through the pouch opening will remain in the pouch even when the pouch opening is not sealed by the action of a clamping mechanism (1008), (1010).

FIG. 10 also shows a cross section (1020), (1022) of the fluid container with pouch embodiment. This cross section (1022) shows a first side of the fluid containing portion of the fluid container (212), as well as the second side of the fluid container (214) that in this embodiment also functions both as a support, as well as also serving as the first side of the pouch. In this embodiment, at least the first side of the fluid containing portion of the fluid container (212) will be made of a deformable material. The second side of the fluid holding portion of the container, which may optionally function as a support (214), as well as also functioning as the first side of the pouch, may or may not be made of a deformable material. That is in some cases, (214) may be made from a substantially rigid material, while in other cases (214) may either be semi-rigid or even fully flexible.

In some configurations, support side (214) may have a laminated structure, composed of a second side of the fluid holding portion of the container, a rigid, semi-rigid, or flexible support material, and a first side of the pouch. This laminated structure (214) thus may serve one side of both the fluid holding portion of the container and one side of the pouch. In other embodiments (214) may only be composed of the second side of the fluid holding portion of the container and the first side of the pouch. In still other embodiments, (214) will be composed of a single material that acts as both the second side of the fluid container and the first side of the pouch.

In some configurations, support side (214) may have a laminated structure, composed of a second side of the fluid holding portion of the container, a rigid, semi-rigid, or flexible support material, and a first side of the pouch. This laminated structure (214) thus may serve one side of both the fluid holding portion of the container and one side of the pouch. In other embodiments (214) may only be composed of the second side of the fluid holding portion of the container and the first side of the pouch. In still other embodiments, (214) will be composed of a single material that acts as both the second side of the fluid container and the first side of the pouch.

In still other embodiments, the support for the unit may come from the second side of the pouch. Generally however, putting the support on the junction or common side between the fluid holding portion of the container and the pouch is preferred because it can help improve the overall balance of the unit.

On the open side of the pouch, near (1006), generally it will be useful to create a flap to facilitate subsequent closure of the pouch (using the clamping mechanism 1008) after the cooling material has been placed in the pouch. This flap may be formed from a portion of the laminated structure (214) on one side, and the second side of the pouch on the other side.

Figure 11:
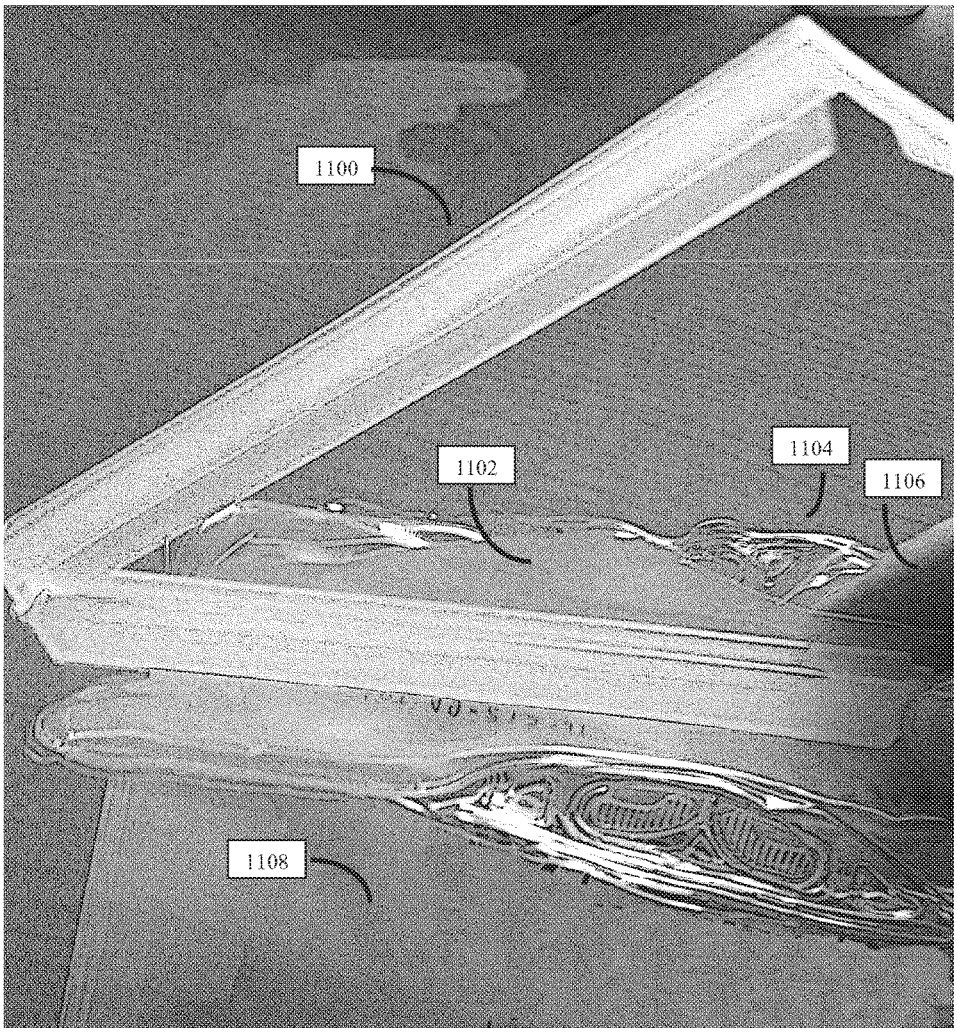
FIG. 11 shows an embodiment where the container also comprises an attached clip-type clamping mechanism, here used to seal the first and second sides of the top of the pouch.

FIG. 11 shows an embodiment where the container also comprises an attached clip-type clamping mechanism (1100), here used to seal the first (1102) and second sides (1104) of the top of the pouch together. The user's finger (1106) is positioned in between the first and second sides of this pouch. The fluid containing part of the container is shown as (1108). In this diagram, there is no fluid cap (207), (902), and the fluid container is empty of fluid. There is also no cooling material in the pouch.

What is claimed is:

1. A method of enterally hydrating a patient with a cooled fluid, said method comprising:

providing a substantially transparent fluid container comprising a plurality of sides which are configured to form a closed and non-refillable space, at least some of said plurality of sides being substantially deformable and another side of the plurality of sides includes a rigid material, wherein at least one of said sides further comprises at least a portion of a side of a pouch;

said pouch configured to both receive and then hold a cooling material against at least one side of said fluid container without said cooling material being in direct contact with fluid in said fluid container;

at least one side of said fluid container comprising a support with a fenestrated opening configured to enable said fluid container to be suspended from a support structure;

said fluid container narrows to a hollow tube;

wherein, when said fluid container is suspended near said patient, said hollow tube having sufficient length to deliver fluid from said fluid container through a mouthpiece at the proximal opening of said hollow tube, said mouthpiece configured to be placed in the mouth of said patient;

said sufficient length being a length between two and 20 feet;

said mouthpiece configured with a valve comprising at least one narrow slit in an elastic and deformable material;

wherein in the absence of patient mouth generated force, said deformable, material holds said slit shut, thus preventing fluid flow;

wherein in the presence of patient mouth generated three, said deformable material deforms thus causing said slit to enlarge and permitting fluid flow;

placing said cooling material into said pouch; wherein said fluid is subsequently cooled by thermal transfer of fluid heat to said cooling material;

mounting said container on a support structure using said fenestrated opening; and providing said tube and mouthpiece to said patient.

2. The method of claim 1, wherein at least one of said container sides contains a fill line and a series of graduated markings and numbers set at various fluid levels so that the quantity of fluid used by said patient may be accurately determined; and wherein the top side of said fluid container further comprises a substantially non-deformable portion with a one-piece rigid or semi-rigid press-clamp cap configured to either open to admit fluids, or snap shut.

3. The method of claim 1, wherein said container is filled with the fluid and sealed using an aseptic technique before use, thus delivering microbial load reduced fluid to said patient.

4. The method of claim 1, wherein said pouch further comprises: first and second pouch sides laminated together to form a pouch structure with an open pouch top, laminated pouch sides, and a laminated bottom; at least a portion of the first side of said pouch sides also forming a side of said fluid container; and the second pouch side comprising a deformable side that has a surface area sufficiently larger than said first pouch side so as to accommodate said cooling material when said cooling material is inserted into said pouch through said open pouch top.

5. The method of claim 4, wherein said fluid container further comprises a flap and a clamping mechanism disposed to allow said flap to be scaled at least after said cooling material has been inserted into said pouch through said open top.

6. The method of claim 1, wherein said valve is configured to open in response to the patient mouth generated force of biting; or wherein said valve is configured to open in response to the patient mouth generated force of suction.

7. The method of claim 1, wherein said hollow tube further comprises a thumb controlled tubing clamp configured to provide an independent method of stopping fluid flow along said hollow tube.

8. The method of claim 1, wherein said hollow tube proximate said mouthpiece, or said mouthpiece, further comprises a clip configured to fix said mouthpiece to a location near the mouth of said patient.

9. The method of claim 1, wherein said container and hollow tube are formed from a polymer selected from the group of transparent polymers generally recognized as suitable for fluid storage and transport in a medical setting.

* * * * *